US010092824B2

(12) United States Patent
Guyer

(10) Patent No.: US 10,092,824 B2
(45) Date of Patent: Oct. 9, 2018

(54) ENTERTAINMENT APPARATUS AND METHOD

(75) Inventor: Reynolds W. Guyer, Boca Grande, FL (US)

(73) Assignee: Winsor Concepts, St. Paul, MN (US)

( * ) Notice: Subject to any disclaimer, the term of this patent is extended or adjusted under 35 U.S.C. 154(b) by 626 days.

(21) Appl. No.: 13/824,689

(22) PCT Filed: Sep. 30, 2011

(86) PCT No.: PCT/US2011/054178

§ 371 (c)(1),
(2), (4) Date: Jul. 3, 2013

(87) PCT Pub. No.: WO2012/044911

PCT Pub. Date: Apr. 5, 2012

(65) Prior Publication Data

US 2013/0285322 A1 Oct. 31, 2013

Related U.S. Application Data

(60) Provisional application No. 61/388,429, filed on Sep. 30, 2010.

(51) Int. Cl.
*A63F 3/00* (2006.01)
*A63F 9/04* (2006.01)

(52) U.S. Cl.
CPC ..... *A63F 9/04* (2013.01); *A63F 3/00* (2013.01); *A63F 9/0413* (2013.01); *A63F 9/0415* (2013.01)

(58) Field of Classification Search
CPC . A63F 9/04; A63F 2011/002; A63F 2009/004
USPC ..... 273/146
See application file for complete search history.

(56) References Cited

U.S. PATENT DOCUMENTS

| | | | | |
|---|---|---|---|---|
| 817,233 A * | 4/1906 | Emmerling | 273/260 |
| 882,945 A | 3/1908 | Hurst | |
| 1,584,316 A * | 5/1926 | Mayhew | 273/146 |
| 2,044,122 A | 6/1936 | Michener | |

(Continued)

FOREIGN PATENT DOCUMENTS

| | | |
|---|---|---|
| CN | 201394345 | 2/2010 |
| FR | 1432719 | 6/1966 |

(Continued)

OTHER PUBLICATIONS

Office Action from related European patent application No. 04 782 581.5 dated Dec. 15, 2011 (4 pages).

(Continued)

*Primary Examiner* — John E Simms, Jr.
*Assistant Examiner* — Dolores Collins
(74) *Attorney, Agent, or Firm* — Westman, Champlin & Koehler, P.A.; Theodore M. Magee

(57) ABSTRACT

An entertainment method comprising shaking a master die and a plurality of scoring dice, and accumulating turn points when a reference designation shown by at least one shaken scoring die corresponds to a master designation shown by the shaken master die, forfeiting turn points when no reference designation of the shaken scoring dice corresponds to any master designation shown by the shaken master die, and collecting a scoring token 16 when the shaken master die shows a token designation.

20 Claims, 9 Drawing Sheets

(56) References Cited

U.S. PATENT DOCUMENTS

| | | | | | |
|---|---|---|---|---|---|
| 2,171,295 | A | * | 8/1939 | Shultz | 273/374 |
| 3,445,115 | A | * | 5/1969 | Hunter | 273/243 |
| 3,608,902 | A | | 9/1971 | Weisbecker | |
| 3,642,286 | A | * | 2/1972 | Moore | 273/243 |
| 3,747,935 | A | | 7/1973 | Engelbrecht | |
| 3,929,337 | A | | 12/1975 | Hayes | |
| 4,346,438 | A | | 8/1982 | Potash et al. | |
| 4,469,329 | A | * | 9/1984 | Guyer | 273/146 |
| 4,587,611 | A | | 5/1986 | Amdahl et al. | |
| 4,648,602 | A | * | 3/1987 | Maroney | 273/146 |
| 4,778,186 | A | * | 10/1988 | Dudley | 273/243 |
| 4,834,386 | A | * | 5/1989 | Rosenthal et al. | 273/146 |
| 4,907,192 | A | | 3/1990 | Kaneko | |
| 4,930,780 | A | | 6/1990 | Goodman et al. | |
| 4,961,581 | A | | 10/1990 | Barnes et al. | |
| 5,080,370 | A | | 1/1992 | Lu | |
| 5,114,147 | A | | 5/1992 | Faylo | |
| 5,176,385 | A | * | 1/1993 | Tagliaferro | 273/244 |
| 5,364,101 | A | * | 11/1994 | Spooner et al. | 273/146 |
| 5,405,145 | A | * | 4/1995 | Jones et al. | 273/146 |
| 5,649,704 | A | * | 7/1997 | Dobbin | 273/268 |
| 5,676,375 | A | * | 10/1997 | Pirouzkhah | 273/274 |
| 5,746,433 | A | * | 5/1998 | Klassen et al. | 273/302 |
| 5,850,553 | A | | 12/1998 | Schlansker et al. | |
| 5,904,353 | A | * | 5/1999 | Aldridge | 273/292 |
| 5,997,000 | A | * | 12/1999 | Nakano et al. | 273/274 |
| 6,120,377 | A | | 9/2000 | McGinnis et al. | |
| 6,209,870 | B1 | | 4/2001 | Shea et al. | |
| 6,227,969 | B1 | | 5/2001 | Yoseloff | |
| 6,299,166 | B1 | | 10/2001 | Factor | |
| 6,386,973 | B1 | | 5/2002 | Yoseloff | |
| 6,508,709 | B1 | | 1/2003 | Karmarkar | |
| 6,605,001 | B1 | * | 8/2003 | Tarantino | 463/22 |
| 6,746,328 | B2 | * | 6/2004 | Cannon et al. | 463/17 |
| 6,851,046 | B1 | | 2/2005 | Delvaux et al. | |
| 6,985,783 | B2 | | 1/2006 | Li et al. | |
| 6,997,803 | B2 | | 2/2006 | LeMay et al. | |
| 7,017,905 | B2 | | 3/2006 | Lindsey | |
| 7,090,579 | B2 | * | 8/2006 | Tarantino | 463/20 |
| 7,118,107 | B2 | | 10/2006 | Niedner et al. | |
| 7,334,792 | B1 | * | 2/2008 | Bermann | 273/146 |
| 7,401,781 | B2 | * | 7/2008 | Guyer et al. | 273/146 |
| 7,500,913 | B2 | | 3/2009 | Baerlocher | |
| 7,566,269 | B2 | | 7/2009 | B-Jensen et al. | |
| 7,810,813 | B2 | * | 10/2010 | Denoual | 273/146 |
| 8,074,985 | B2 | * | 12/2011 | Guyer | 273/146 |
| 8,272,945 | B2 | * | 9/2012 | Kelly et al. | 463/25 |
| 8,342,524 | B2 | * | 1/2013 | Guyer et al. | 273/146 |
| 8,398,081 | B1 | * | 3/2013 | Girolmo et al. | 273/268 |
| 8,413,987 | B2 | * | 4/2013 | Guyer et al. | 273/146 |
| 8,491,389 | B2 | * | 7/2013 | Weston et al. | 463/37 |
| 8,734,245 | B2 | * | 5/2014 | Kelly et al. | 463/30 |
| 8,814,648 | B2 | * | 8/2014 | Baerlocher et al. | 463/16 |
| 2006/0192337 | A1 | | 8/2006 | Oharenko | |

FOREIGN PATENT DOCUMENTS

| | | |
|---|---|---|
| GB | 2191410 | 12/1987 |
| WO | 2005021116 | 3/2005 |
| WO | 2008063044 | 5/2008 |
| WO | 2012044911 | 4/2012 |

OTHER PUBLICATIONS

Supplemental EPO Search Report for PCT/US2004028140 dated Aug. 27, 2007 from the European Patent Office, 4 pages.

Bunco Rules, The Rules of Bunco, 5 pages, Aug. 2, 2004.

International Search Report dated Jan. 9, 2012, for International Application No. PCT/US2011/054178 (5 pages).

Written Opinion of the International Searching Authority for International Application No. PCT/US2011/054178 (6 pages).

* cited by examiner

ENTERTAINMENT APPARATUS AND METHOD

CROSS-REFERENCE TO RELATED APPLICATION

This Application is a Section 371 National Stage Application of International Application No. PCT/US2011/054178, filed Sep. 30, 2011, and published as WO2012/044911 on Apr. 5, 2012, in English, which is a non provisional of U.S. Provisional Patent Application No. 61/388,429, filed Sep. 30, 2010, the contents of which are hereby incorporated by reference in their entirety.

BACKGROUND

The present disclosure relates generally to an apparatus and method for performing an event of chance and entertainment. More specifically, the present disclosure is directed to a method that uses a relationship between a master indicator and several scoring indicators to determine a player's score.

Games of chance and entertainment exist in a variety of forms. The gambling industry, namely casinos, offers players several gaming options. These options however, are often elaborate games involving complex rules and requiring special tables or machines. Players therefore are unable to reenact the excitement in private without sufficient expense.

There also exists several games for a player to play in person, either alone or with other players. These games however, are often exceedingly simple and do not offer the player a significant level of risk or excitement. Therefore these games are unable to consistently offer the player a desired level of entertainment.

SUMMARY

An aspect of the present disclosure is directed to an entertainment method, which includes providing a master die comprising multiple master designations and a token designation, and providing a plurality of scoring dice each having multiple reference designations corresponding to the multiple master designations of the master die, and having a score value associated with each reference designation. The method also includes shaking the master die and the plurality of scoring dice, and accumulating turn points when a reference designation shown by at least one shaken scoring die corresponds to any of the multiple master designations shown by the shaken master die. The method further includes forfeiting turn points when no reference designation of the shaken scoring dice corresponds to any of the multiple master designations shown by the shaken master die, and collecting a scoring token when the shaken master die shows the token designation, where the scoring token has an assigned value.

Another aspect of the present disclosure is directed to an entertainment method, which includes shaking a master die comprising multiple master designations and a token designation, and shaking a plurality of scoring dice each having multiple reference designations corresponding to the multiple master designations of the master die, and that do not correspond to the token designation. The method also includes comparing the shaken master die to the shaken scoring dice, and providing alternative options when the shaken master die shows the token designation. The alternative options include collecting a first scoring token and ending a turn, and forgoing collection of the first scoring token and repeating the shaking of the master die and the shaking of the scoring dice.

Another aspect of the present disclosure is directed to an entertainment method, which includes (a) shaking a master die comprising multiple master designations and a token designation, (b) shaking a plurality of scoring dice each having multiple reference designations corresponding to the multiple master designations of the master die, and (c) accumulating points based on comparisons of the shaken master die and the shaken scoring dice. The method also includes (d) collecting a scoring token when the shaken master die shows the token designation, and (e) repeating at least steps (a)-(c) until the accumulated points are equal to or exceed a predetermined threshold score. The method further includes (f) adding an assigned value of any collected scoring token to the accumulated points when the accumulated points are equal to or exceed the predetermined threshold score to determined a total point value.

This summary is provided to introduce a selection of one or more concepts in a simplified form that are further described below in the Detailed Description and Examples. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure is directed to an entertainment method of chance, performed with a master indicator (e.g., a master die), a plurality of score indicators (e.g., scoring dice), and one or more scoring tokens. As discussed below, the method may be performed with a physical kit of playing pieces and/or with an electronic version thereof. For ease of discussion, the following discussion is made with references to "die" and "dice" (e.g., a master die and scoring dice) with the understanding that the apparatus and method of the present disclosure may be performed with a variety of different indicators and electronic expressions thereof. Additionally, as used herein, the terms "shake", "shaking", and the like refer to a roll or throw of one or more dice (or electronic expression thereof) by a player.

Figure 1:
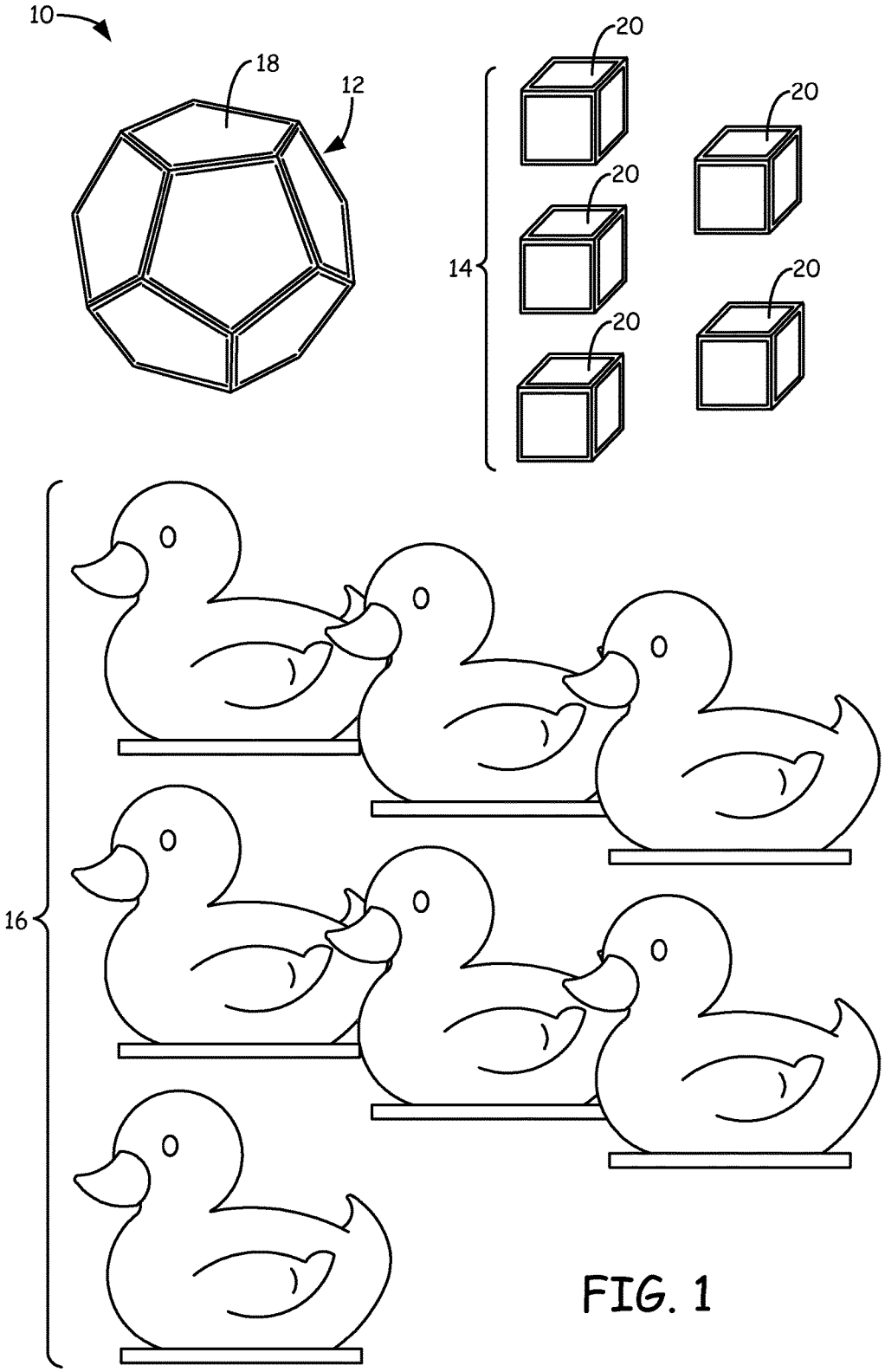
FIG. 1 is a schematic illustration of playing pieces for playing the entertainment method of the present disclosure.

As shown in FIG. 1, the method may performed with playing pieces 10, which include a single master die 12, multiple scoring dice 14, and one or more scoring tokens 16, which are used in combination to determine a player's score. While illustrated with five scoring dice 14 and seven scoring tokens 16, any suitable number of scoring dice 14 and scoring tokens 16 may be used. Furthermore, while master die 12 and scoring dice 14 are respectively illustrated as a twelve-sided die and six-sided dice, in alternative embodiments, master die 12 and scoring dice 14 may have any desired number of sides. The twelve and six-sided dice, however, are found to create an entertaining amount of chance for the method. Moreover, for ease of playability, master die 12 is desirably visually distinguishable from scoring dice 14, such as through size, color, and/or the number of sides.

While the method or game discussed herein can be performed by a single player for scoring purposes, it is typically played by multiple players. The object of the method is for a player to score more points than any of the opposing players, based on the relationships between master die 12 and scoring dice 14, and based on point values of scoring tokens 16.

As discussed below, the method is performed in an initial round, followed by a final round. During the initial round, each player's turn begins by shaking master die 12 and scoring dice 14, and accumulating "turn points" based on the relationship between the resulting master die 12 and scoring dice 14. FIG. 1 illustrates master die 12 and scoring dice 14, and their respective top sides 18 and 20, after a shake. As is typical with dice games, the top sides 18 and 20 may be used for scoring purposes. One way that points are scored is when the designations shown on the top side 20 of at least one scoring die 14 matches or otherwise corresponds to the designation shown on the top side 18 of master die 12.

During the player turns in the initial round, the players may also acquire scoring tokens 16, which add interesting elements of strategy and chance to a player's score in the final round. Scoring tokens 16 have associated point values, such as 10 or 20 points, which may be added to a player's score in the final round when certain criteria are met. In the shown embodiment, scoring tokens 16 are depicted as ducks for a duck pond-based theme. However, scoring tokens 16 may alternatively be provided in a variety of different forms, such as cards, icons, figurines, and the like. For example, scoring tokens 16 may be card-based figurines that depict animals, such as birds, cats, dogs, farm animals, wild animals, and the like. Scoring tokens 16 may also be based on any suitable theme, such as themes from movies, television, video games, books, music, and the like.

The initial round is played until one of the players reaches a predetermined threshold score, such as 50 or 100 points. Then, the method proceeds to the final round, where each player may attempt to outscore their opponents to win the game. In the final round, the point values associated with a player's scoring tokens 16 may also potentially be added to the player's points in determining the player's overall score. As mentioned above, this adds interesting elements of strategy and chance to the game when determining a winner.

Figure 2:
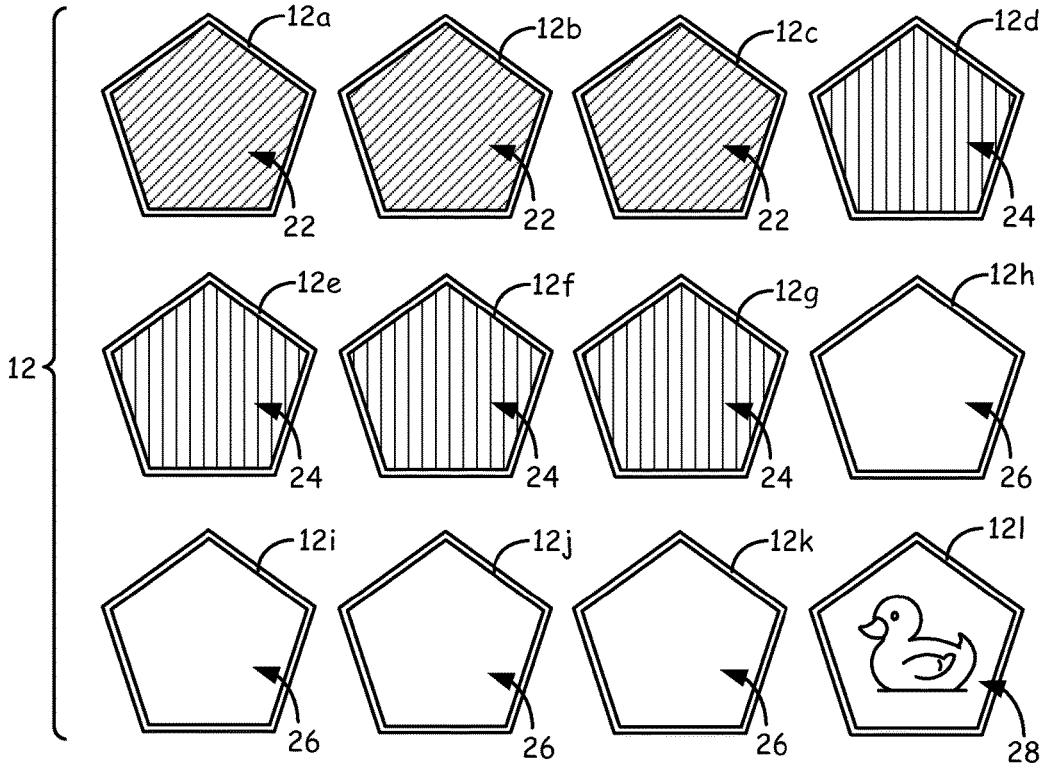
FIG. 2 is a generated view of each of the twelve sides and accompanying indicia of a master die of the playing pieces.

FIG. 2 is a generated view of the twelve sides of master die 12 (referred to as sides 12*a*-12*l*), where each side is flat and pentagon shaped. In the illustrated embodiment, sides 12*a*-12*l* of master die 12 have four different indicia or master designations, including three master designations 22 (e.g., red) borne on sides 12*a*-12*c*, four master designations 24 (e.g., blue) borne on sides 12*d*-12*g*, four master designations 26 (e.g., white) borne on sides 12*h*-12*k*, and a single token designation 28 borne on side 12*l*.

In the shown example, master designations 22, 24, and 26 are differentiated by colors (e.g., red, blue, and white), and token designation 28 is a readily discernable alternative indicia, such as, for example, an image of a duck or a cat. In alternative embodiments, however, master designations 22, 24, and 26 can be represented by any suitable indicia, such as numbers, patterns, letters, colors, brail lettering, or the like, and/or combinations thereof. As used herein, the term "indicia" includes any type of visual or topographical design that allows players to distinguish the different designations.

Figure 3:
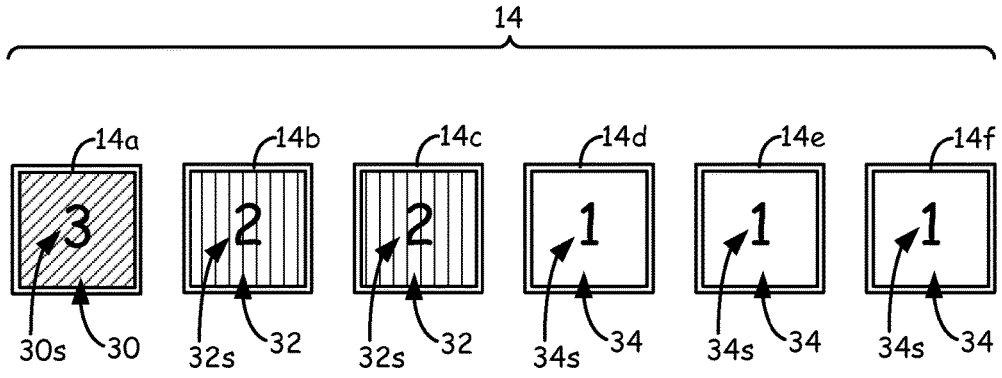
FIG. 3 is a generated view of each of the six sides and accompanying indicia of a scoring die of the playing pieces.

FIG. 3 is a generated view of the six sides of each scoring die 14 (referred to as sides 14*a*-14*f*), where each side is flat and square shaped. In the illustrated embodiment, sides 14*a*-14*f* of each scoring die 14 have three different indicia or reference designations 30, 32, and 34 with associated score values 30*s*, 32*s*, and 34*s*. In particular, each scoring die 14 includes including a single reference designation 30 (e.g., red) and associated score value 30*s* (e.g., 3 points) borne on side 14*a*, two reference designations 32 (e.g., blue) and associated score values 32*s* (e.g., 2 points) borne on sides 14*b* and 14*c*, and three reference designations 34 (e.g., white) and associated score values 34*s* (e.g., 1 point) borne on sides 14*d*-14*f*.

In alternative embodiments, however, reference designations 30, 32, and 34 can be represented by any suitable indicia, such as numbers, patterns, letters, colors, brail lettering, or the like, and/or combinations thereof. Furthermore, score values 30*s*, 32*s*, and 34*s* may have different corresponding values, as desired for game play. Moreover, the points of score values 30*s*, 32*s*, and 34*s* may represent arbitrary point values, simulated monetary values, or real monetary values, or the like.

As shown in FIGS. 2 and 3, reference designations 30, 32, and 34 of each scoring die 14 respectively match or otherwise correspond to master designations 22, 24, and 26 of master die 12. In particular, reference designation 30 matches master designations 22, reference designations 32 match master designations 24, and reference designations 34 match master designations 26. As discussed below, the relationships between master designations 22, 24, and 26 and reference designations 30, 32, and 34 are important for performing the method.

FIGS. 4A-4H illustrate top sides 18 and 20 of master die 12 and scoring dice 14 after example shakes that a player may make. For each example shake shown in FIGS. 4A-4H, a brief explanation is provided to explain the results of the given shake, such as how turn points are accumulated and how scoring tokens 16 are collected.

Figure 4A:
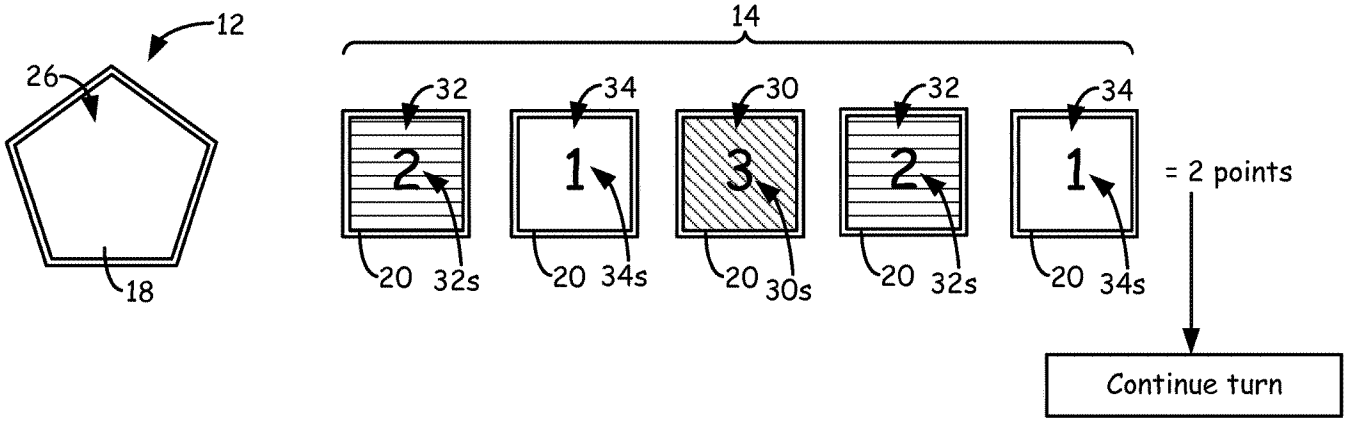
FIGS. 4A-4H are generated views of example shakes of a master die and scoring dice.

As shown in FIG. 4A, after the shake, master die 12 shows master designation 26. Correspondingly, the first scoring die 14 shows reference designation 32, the second scoring die 14 shows reference designation 34, the third scoring die 14 shows reference designation 30, the fourth scoring die 14 shows reference designation 32, and the fifth scoring die 14 shows reference designation 34.

The player's accumulated points for this shake are determined by determining which of scoring dice 14 have top sides 20 showing reference designations that match master designation 26 of master die 12, and then adding up the associated score values 30*s*, 32*s*, or 34*s*. In the example shown in FIG. 4A, the second and fifth scoring dice 14 show reference designations 34, which match master designation 26 of master die 12. Each reference designation 34 is associated with score value 34*s*, depicting "one point". As such, the player's accumulated points for this shake is two points. As discussed below, after this shake, the player may then continue the turn or bank the accumulated points.

Figure 4B:
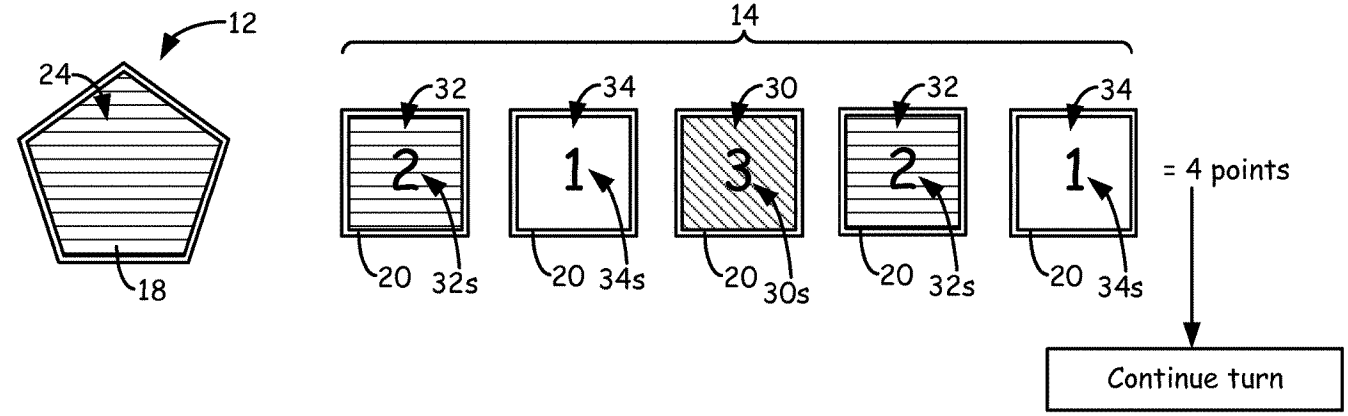

FIG. 4B illustrates an example in which master die 12 shows master designation 24 after the shake, and scoring dice 14 are the same as shown in FIG. 4A. In this example, the first and fourth scoring dice 14 show reference designations 32, which match master designation 24. Each reference designation 32 is associated with score value 32*s*, depicting "two points". As such, the player's accumulated points for this shake is four points, and the player may then continue the turn or bank the accumulated points, as discussed below.

Figure 4C:
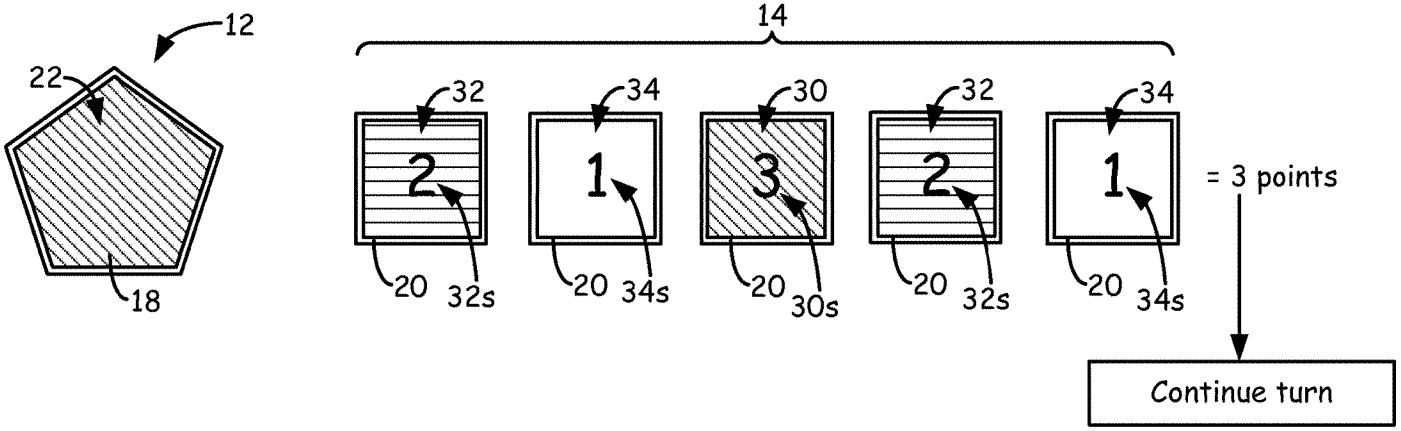

FIG. 4C illustrates an example in which master die 12 shows master designation 22 after the shake, and scoring dice 14 are the same as shown in FIG. 4A. In this example, the third scoring die 14 shows reference designation 30, which matches master designation 22. Reference designation 30 is associated with score value 30*s*, depicting "three points". As such, the player's accumulated points for this shake is three points, and the player may continue the turn or bank the accumulated points, as discussed below.

Figure 4D:
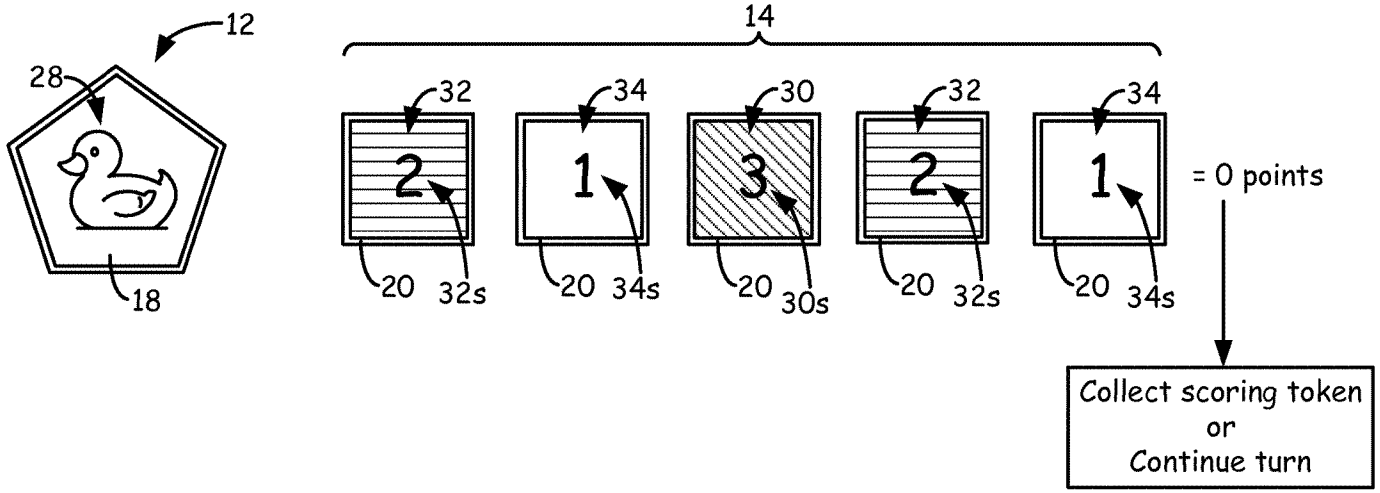

FIG. 4D illustrates an example in which master die 12 shows token designation 28 after the shake, and scoring dice 14 are the same as shown in FIG. 4A. In this example, none of the top sides 20 of scoring dice 14 match or otherwise correspond to token designation 28. In this case, as discussed below, the player has the option to (1) collect one scoring token 16 and end the player's turn, or (2) forgo collecting the scoring token 16 and continue the turn with another shake of master die 12 and scoring dice 14.

Figure 4E:
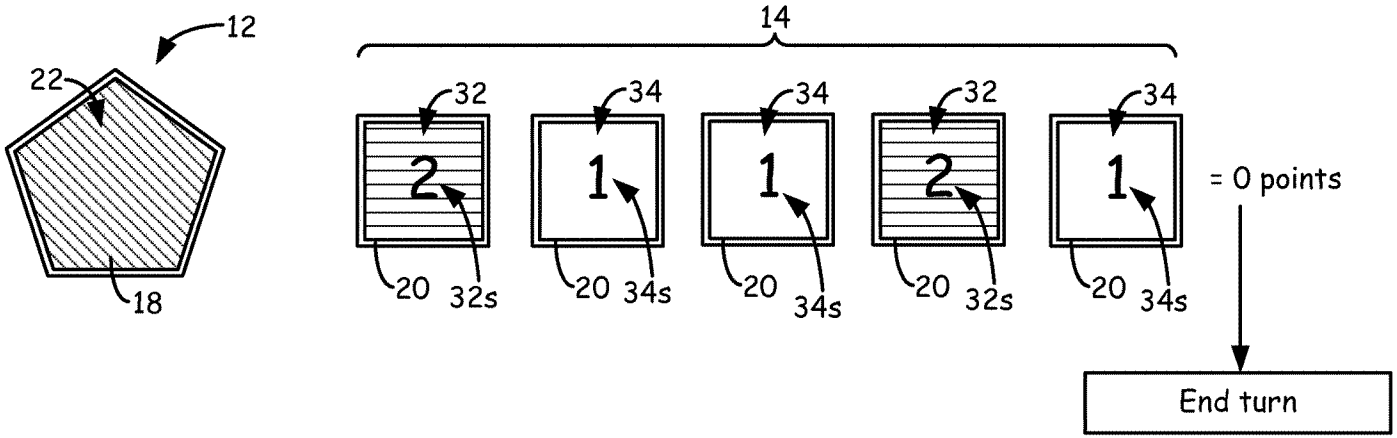

FIG. 4E illustrates an example in which master die 12 shows token master designation 22 after the shake. In this example, scoring dice 14 are similar to those shown in FIG. 4A, with the exception of third scoring die 14, which shows reference designation 34 rather than reference designation 30. As such, master designation 22 does not match any shown reference designation (i.e., reference designations 32 and 34). As discussed below, this is a zero-value shake and results in the player's turn ending, plus a forfeiture of any of the player's points accumulated in the current turn.

Figure 4F:
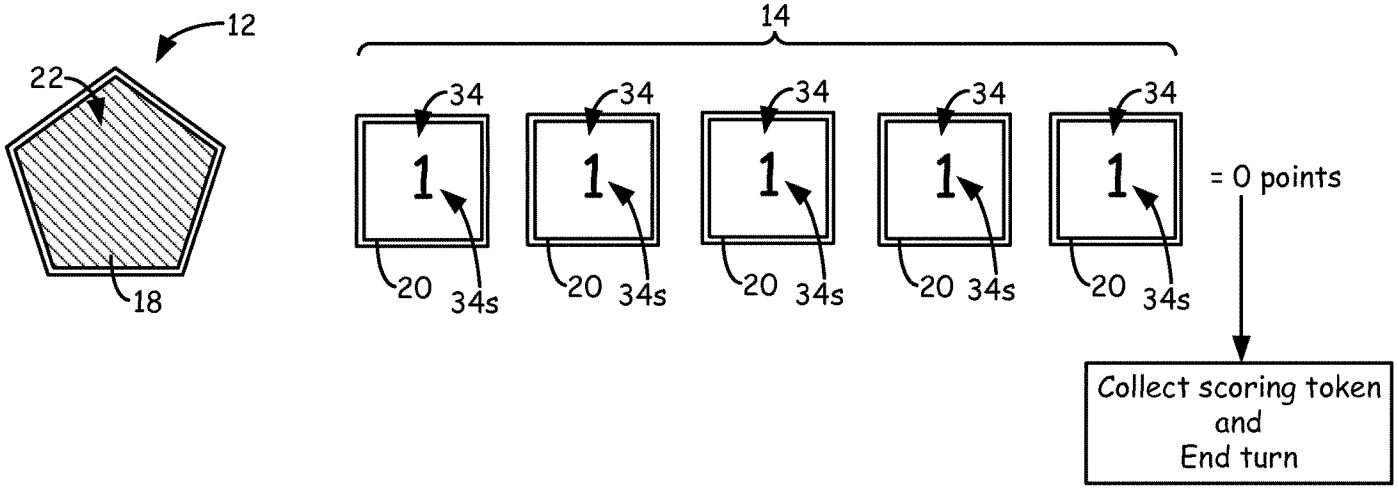

FIG. 4F also illustrates an example in which master die 12 shows token master designation 22 after the shake. In this example, however, each scoring die 14 is the same and shows reference designation 34. As discussed below, when each scoring die 14 shows the same reference designation, the player may collect one scoring token 16 for potential use in the final round. As further shown, master designation 26 does not match the common reference designation shown by scoring dice 14. As such, this results in the player's turn ending, and a forfeiture of any points accumulated in the current turn. However, the player retains the collected scoring token.

Figure 4G:
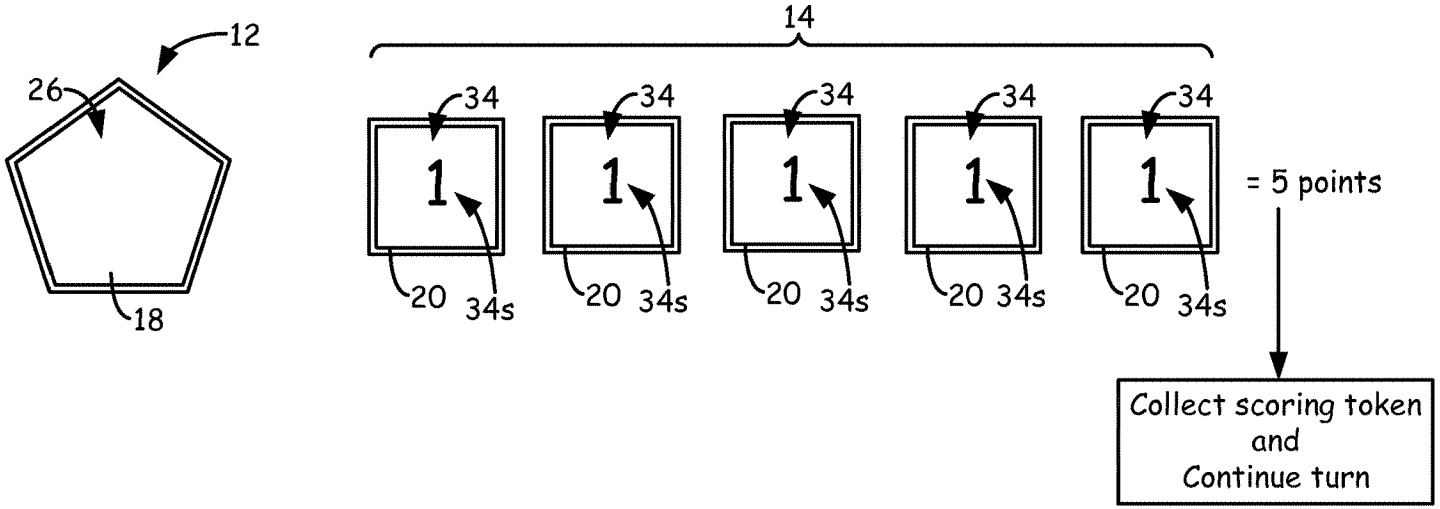

FIG. 4G illustrates a similar example to that shown above in FIG. 4F. In this example, master die 12 shows master designation 26 and each scoring die 14 is the same and shows reference designation 34. In this case, master designation 26 matches the common reference designation 34 shown on all scoring dice 14. As such, the player may collect one scoring token 16 for potential use in the final round, may accumulate five points for this shake, and may continue the turn or bank the accumulated points.

Figure 4H:
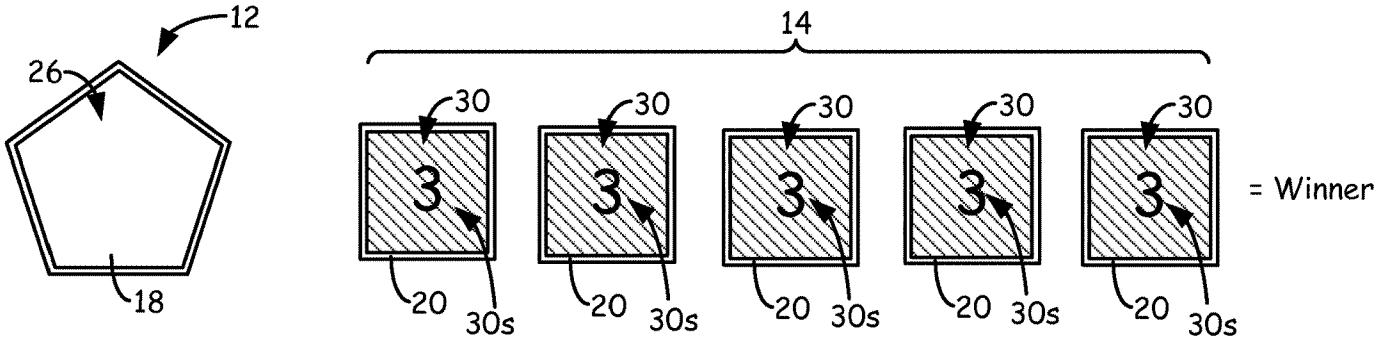

FIG. 4H illustrates another similar example to those shown above in FIGS. 4F and 4G. In this example, however, each scoring die 14 shows reference designation 30, which is the rarest of reference designations 30, 32, and 34 (i.e., 1:6 odds per die). In one embodiment of the game, when each scoring die 14 shows reference designation 30, this triggers an automatic win of the game for the given player, regardless of which master designation is shown by master die 12. In the shown example, the odds of attaining all five six-sided dice 14 showing reference designation 30 is 1:7,776. Nonetheless, this provides a small amount of uncertainty in the game, allowing each player to have a chance to win outright regardless of any player's score.

Figure 5:
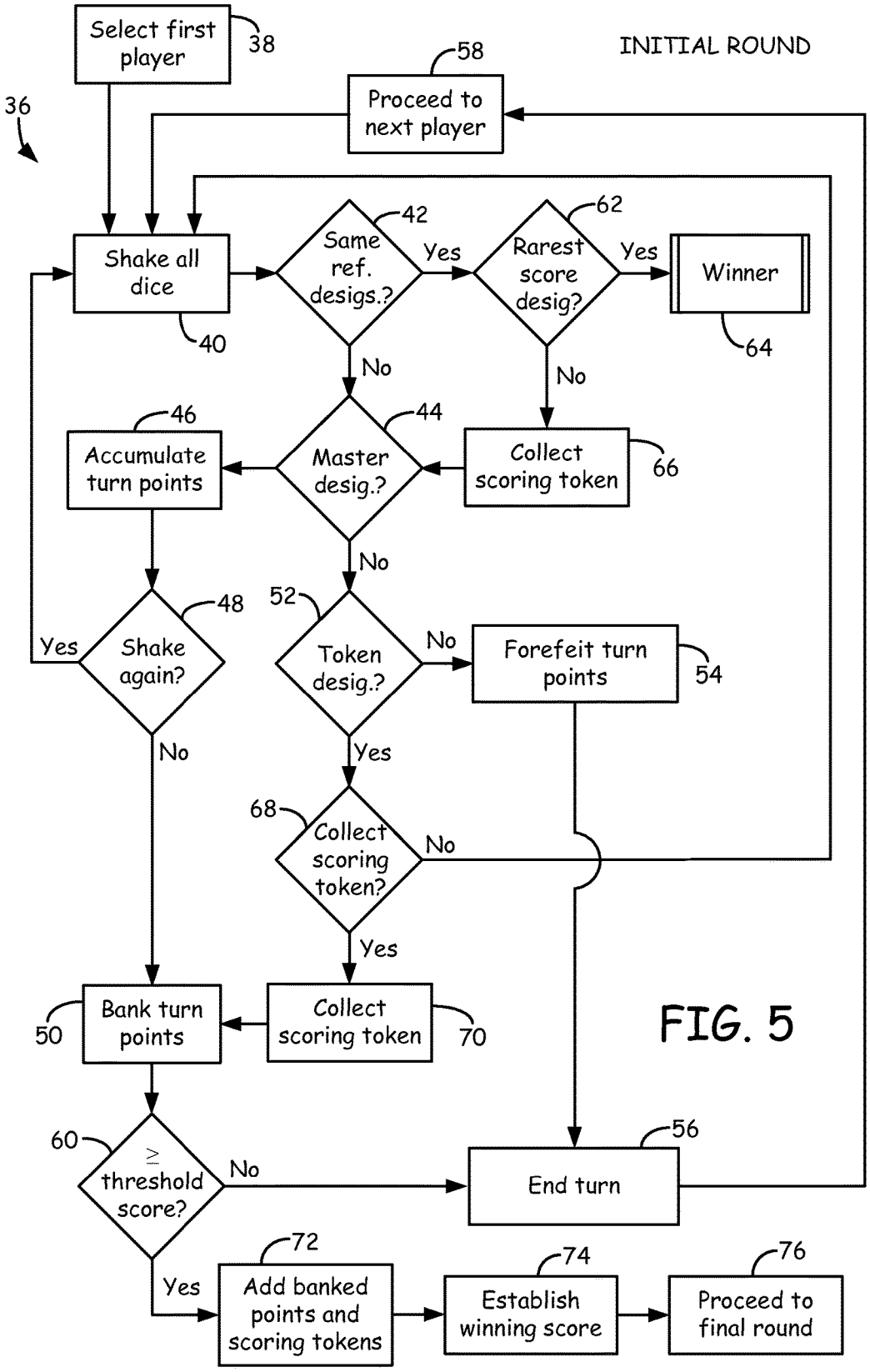
FIG. 5 is a block diagram illustrating the steps for performing an initial round of the method of the present disclosure.
Figure 6:
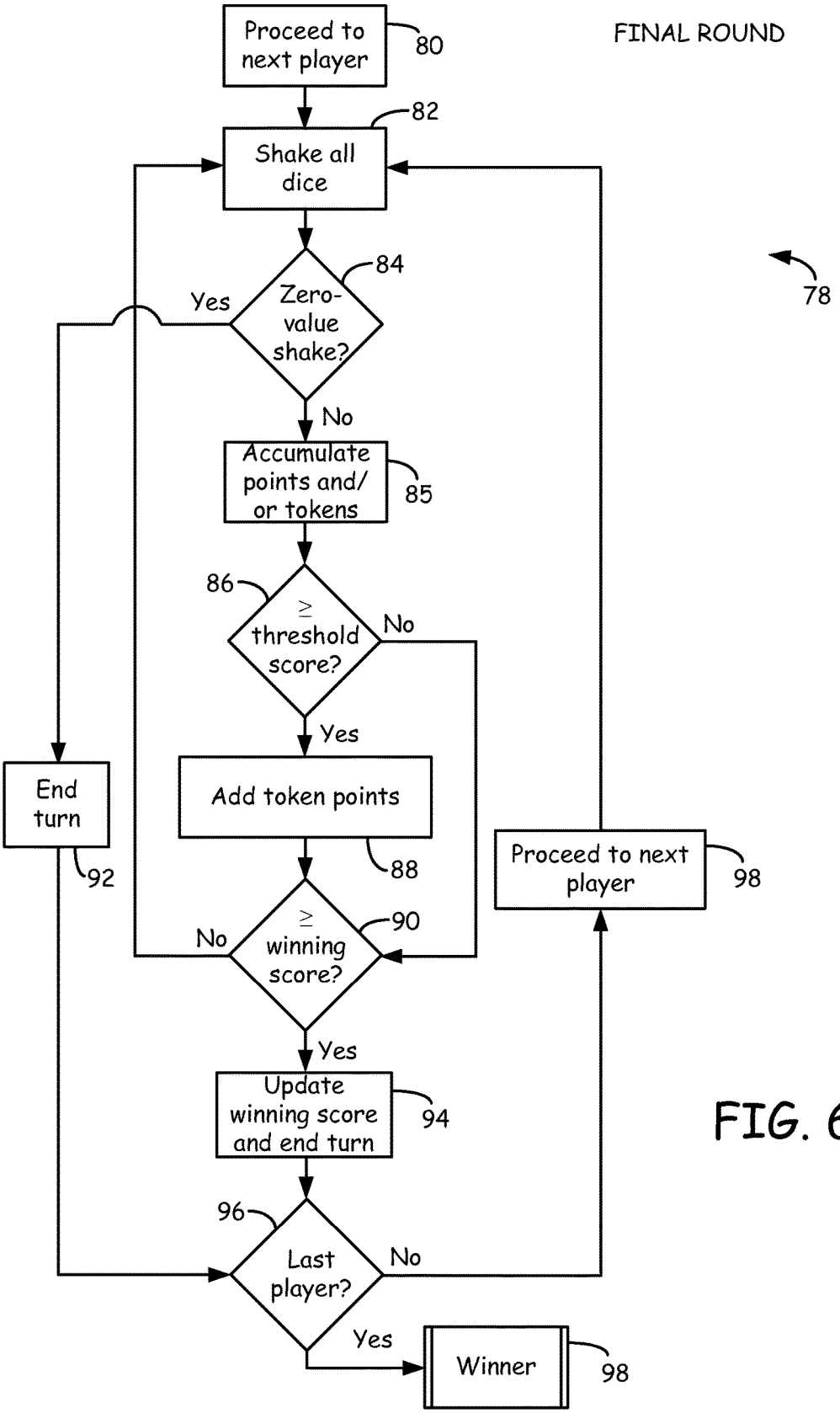
FIG. 6 is a block diagram illustrating the steps for performing a final round of the method of the present disclosure.

FIGS. 5 and 6 illustrate example steps for performing the initial and final rounds of the entertainment method of the present disclosure. The following discussion of these initial and final methods is made with reference to playing pieces 10 (i.e., master die 12, scoring dice 14, and scoring tokens 16) and players A-E. However, these methods may alternatively be performed with different types and numbers of master indicators, scoring indicators, and/or scoring tokens, and with any suitable number of players, as discussed above. Furthermore, the following discussion of the initial and final methods provides a detailed, step-by-step analysis on how the methods may be performed. In reality, however, players may perform multiple steps of these methods together, and may also omit various unnecessary or redundant steps of these methods, to keep the game lively and entertaining.

FIG. 5 shows method 36 for performing the initial round of the game, and includes steps 38-76. Method 36 initially involves selecting a first player out of the group of multiple opposing players A-E (step 38). This may involve having each player shake master die 12 and/or scoring dice 14, and determining which player has the highest point value from the shakes. In the current example, it is assumed that player A is the first selected player, and the order of play then moves sequentially to players B-E. This sequential pattern of players A-E may then be repeated as many times as necessary to complete the initial round of the game.

After selection, player A shakes master die 12 and scoring dice 14, and observes the resulting master and reference designations shown on top sides 18 and 20 (step 40). As discussed above, the resulting actions are dependent on a comparison between master die 12 and scoring dice 14, as well as a determination of whether scoring dice 14 show a common reference designation. If scoring dice 14 do not show a common reference designation (i.e., at least one scoring die 14 shows a reference designation that is different from that of any other another scoring die 14) (step 42), then player A checks whether any reference designation shown by scoring dice 14 matches the master designation shown by master die 12 (step 44). For example, if master die 12 shows master designation 26, player A checks whether any scoring die 14 shows reference designation 34.

If at least one scoring die 14 shows a reference designation that matches the master designation shown by master die 12, then the points from the shake are accumulated as turn points (step 46). For example, if the shaken master die 12 and scoring dice 14 result as shown in FIG. 4A, then player A accumulates 2 turn points.

Pursuant to step 48, player A then has the option to either shake again (step 40), or to bank the accumulated turn points (step 50) and end the turn, as discussed below. If player A decides to shake master die 12 and scoring dice 14 again, he or she may do so, pursuant to step 40. If, for example, player A's second shake results in the arrangement shown in FIG. 4B, then the condition of step 42 is not met, and player A accumulates 4 turn points (steps 44 and 46), which are added to the 2 turn points from player A's first shake to provide a total of 6 turn points.

Pursuant to step 48, player A then again has the option to either shake again (step 40), or to bank the accumulated turn points (step 50) and end the turn. As such, player A may continue to shake master die 12 and scoring dice 14 until either he or she decides to bank his or her accumulated turn points or until a turn ending event occurs, such as a zero-value shake. In the current example, if player A is feeling lucky and wishes to shake again (steps 48), he or she may do so (step 40). If, for example, player A's third shake results in the arrangement shown in FIG. 4E, which is a zero-value shake, then the conditions of steps 42, 44, and 52 are not met, and player A forfeits all of his or her accumulated turn points that have not been previously banked (i.e., all 6 points) (step 54). Player A's turn also ends (step 56), and master die 12 and scoring dice 14 are handed to player B (step 58).

Player B may then shake master die 12 and scoring dice 14 (step 40). If, for example, player B's shake results in the arrangement shown in FIG. 4C, then the condition of step 42 is not met, and player B accumulates 3 turn points (steps 44 and 46). Pursuant to step 48, player B then has the option to either shake again (step 40), or to bank the accumulated turn points (step 50) and end the turn. If, for example, player B decides to bank the accumulated points at step 50, player B's turn points accumulated during the current turn are banked with any previously banked points for player B. As such, at this point in the game, player B has banked 3 points.

Player B's banked points are safe from the forfeiture in step 54, and are retained by player B throughout the game. As can be appreciated, the options in step 48 require each player to balance the risk of forfeiting the accumulated turn points versus the benefit of accumulating more turn points (and possibly scoring tokens 16). This results in an entertaining level of chance for each player based on how aggressive or conservative the player is.

Player B's banked points are then compared to a predetermined threshold score (step 60). In the current example, it is assumed that the predetermined threshold score is 50 points. In alternative embodiments, however, the predetermined threshold score may be any suitable score, such as 100 points. This comparison in step 60 is the triggering event for switching the game from the initial round shown in FIG. 5 and described by method 36 to the final round shown in FIG. 6. In the current example, player B's banked 3 points are less than the predetermined threshold score of 50 points. As such, player B's turn ends (step 56), and master die 12 and scoring dice 14 are handed to player C (step 58).

Player C may then shake master die 12 and scoring dice 14 (step 40). If, for example, player C's first shake results in the arrangement shown in FIG. 4E or other zero-value shake, then the conditions of step 42, 44, and 46 are not met. Player C forfeits all accumulated turn points that have not been previously banked (which, at this point is zero points) (step 54). Player C's turn also ends (step 56), and master die 12 and scoring dice 14 are handed to player D (step 58).

Player D may then shake master die 12 and scoring dice 14 (step 40). If, in this example, each scoring die 14 shows the same reference designation (e.g., as shown in FIGS. 4F-4H) (step 42), then a determination is made whether the shown common reference designation is reference designation 30, which is the rarest of reference designations 30, 32, and 34 (step 62). If so (e.g., as shown in FIG. 4H), then player D automatically wins the game (step 64), bypassing the final round shown in FIG. 6.

As mentioned above, while the odds of attaining this are low, steps 62 and 64 of method 36 provide a small amount of uncertainty in the game, allowing each player to have a chance to win outright regardless of any player's score. In an alternative embodiment of the game, steps 62 and 64 of method 36 may be omitted to preclude this automatic win of the game.

Alternatively, in step 62, if the common reference designation shown by all scoring dice 14 is reference designation 32 or 34 (i.e., not the rarest reference designation), then player D collects a single scoring token 16 for potential use in the final round (step 66). In other words, when scoring dice 14 show a common reference designation that does not qualify as an automatic win in step 64, then the given player may collect a single scoring token 16 for potential use in the final round (step 66).

After collecting a scoring token 16, if, in step 44, the common reference designation shown by scoring dice 14 matches the master designation shown by master die 12, then the points from the shake are accumulated as turn points (step 46). For example, if the shaken master die 12 and scoring dice 14 result in the arrangement shown in FIG. 4G, then player D accumulates 5 turn points (in addition to collecting the scoring token 16 in step 66). Pursuant to step 48, player D then has the option to either shake again (pursuant to step 40), or to bank the accumulated turn points (step 50) and end the turn (step 56), as discussed above.

Alternatively, if, in step 44, the common reference designation shown by scoring dice 14 does not match the master designation shown by master die 12 (e.g., as shown in FIG. 4F), and if master die 12 does not show token designation 28 (step 52), then player D forfeits all accumulated turn points that have not previously been banked (step 54). However, player D retains the collected scoring token 16. Player D's turn then ends (step 56) and master die 12 and scoring dice 14 are handed to player E (step 58).

Player E may then shake master die 12 and all scoring dice 14 (step 40). If, for example, after Player E's shake, master die 12 shows token designation 28 (e.g., as shown in FIG. 4D) (step 52), then the reference designations shown by scoring dice 14 will not match the master designation shown by master die 12 in step 44, since reference designations 30, 32, and 34 do not match to token designation 28. Instead, at step 68, player E has the option to either collect a single scoring token 16 and end the turn, or forgo collecting a scoring token 16 and shake again pursuant to step 40.

If player E elects to collect a single scoring token 16 (step 70), player E's turn points accumulated during the current turn are banked with any previously banked points for player E (step 50). Because player E cannot accumulate any additional points during this shake, player E's points will not have increased to be equal to or exceed the predetermined threshold score of 50 points in step 60. As such, player E's turn ends (step 56), and master die 12 and scoring dice 14 are handed to player A (step 58).

In one embodiment of method 36, when a player is entitled to collect a single scoring token 16 (i.e., in steps 66 and 70), and if the supply of scoring tokens 16 is empty, then the given player may take a single scoring token 16 from any other player. For example, if all seven scoring tokens 16 are collected by players A-E, and player E is entitled to collect a single scoring token 16 in step 66 or step 70, then player E may choose which other player A-D to take the scoring token 16 from. As can be appreciated, this provides an enhanced level of strategy to the game and can have significant effects on the final round.

The above-discussed steps for method 36 may be repeated until the banked points of one of the players is equal to or exceeds the predetermined threshold score at step 60. When this occurs, the point values of any scoring token 16 collected by the given player are added to the player's banked points (step 72). The resulting point total is then established as the winning score to beat (step 74), and the method proceeds to the final round shown in FIG. 6 (step 76). For example, if player D attains 52 banked points during the initial round and has collected one 10-point scoring token 16, then player D's total banked points after the initial round is 62 points. This 62 points is then established as the winning score to beat in the final round.

As discussed below, in the final round, the point values for each scoring token 16 collected by any player may be added to the given player's banked points once the player's banked points are equal to or exceed the predetermined threshold score. Due to the logistics of method 36 shown in FIG. 5, because the initial round ends when a player reaches or exceeds the predetermined threshold score of 50 points, only that given player will have banked enough points to be equal to or exceed the predetermined threshold score. As such, after the initial round, only this given player will be able to add the point values of any scoring tokens 16 collected to the player's banked points.

FIG. 6 shows method 78 for performing the final round of the game, and includes steps 80-99. The final round pursuant to method 78 provides each player with a chance to win the game, despite the fact that a particular player (e.g., player D) has established the winning score. Method 78 initially involves selecting a player other than the player with the established winning score, such as player E (step 80).

The selected player E then shakes master die 12 and scoring dice 14 (step 82), and checks whether it is a zero-value shake (step 84). As discussed above in steps 42, 44, and 52 of method 36 (shown in FIG. 5), a zero-value shake occurs when there is no common reference designation shown by scoring dice 14, when none of the reference designations shown by scoring dice 14 match the master designation shown by master die 12, and when master die 12 does not show token designation 28.

If player E's shake is a zero-value shake, then player E's turn ends and player E will not win the game. Alternatively, if player E's shake is not a zero-value shake, then player E accumulates turn points and/or a scoring token 16 (step 85). As can be appreciated, acquiring a scoring token 16 in the final round, particularly if collected from another player such as player D, can have a significant impact on the results of the game.

If, during player E's turn, his or her combined banked points and accumulated turn points are equal to or exceed the predetermined threshold limit (step 86), then the point value of any scoring token 16 collected by player E are also added to player E's points (step 88). However, player E's points must be equal to or exceed the predetermined threshold limit before step 88 applies.

Player E's points are then compared to the current winning score to beat (i.e., 62 points) (step 90). If player E's points are less than the winning score to beat, player E may then shake again (step 82) and repeat this process until either player E shakes a zero-value score in step 84, or player E's points (including point values of any scoring token 16 from step 88) surpasses the winning score to beat in step 90, whichever occurs first.

If, for example, player E shakes a zero-value score in step 84, then his or her turn is over (step 92) and player E will not win the game (and player D remains the current winner). Alternatively, if player E accumulates enough turn points such that player E's total points (including the point values from player E's scoring tokens 16) surpasses player D's established winning score to beat (step 90), As such, the winning score to beat is updated with player E's points and player E's turn ends (step 94).

After player E's turn ends (either by step 92 or by step 94), a check is then made whether each player has shaken in the final round (step 96). In this case, players A-D still have not shaken in the final round. As such, master die 12 and scoring dice 14 are handed to player A (step 98), and player A may then perform a shake turn in the final round pursuant to steps 82-96. Steps 82-98 may then be repeated for each successive player B-D until each player performs a shake turn in the final round.

It is noted that if players A-D had not surpassed player D's originally established winning score to beat, player D would remain the current winner and would not need to shake in the final round. However, if any other player updates the winning score in step 94, player D would then receive an opportunity to surpass the updated winning score.

Furthermore, since player D's scoring tokens 16 have already been attributed to player D's banked points (from step 72 of method 36), step 88 of method 78 is omitted during player D's turn unless player D collects any additional scoring tokens 16 during his or her turn in the final round. In other words, the point value for each scoring token 16 is only applied once.

After each player A-E has performed a shake turn in the final round (step 96), the player that has the highest total points, and who established or updated the current winning score to beat, is declared the winner of the game (step 99). In the event of a tie, where two or more players have the same total points after all players A-E have performed shake turns in the final round, an overtime round may then be performed. In this case, each tied player may perform an additional shake turn pursuant to method 78. Whichever player has the highest point value during the additional shake turns in the overtime round is declared the winner of the game. If winning ties occur during the overtime round, the overtime round may then be repeated until a single player attains the highest point total, and is thereby declared the winner of the game.

Figure 7:
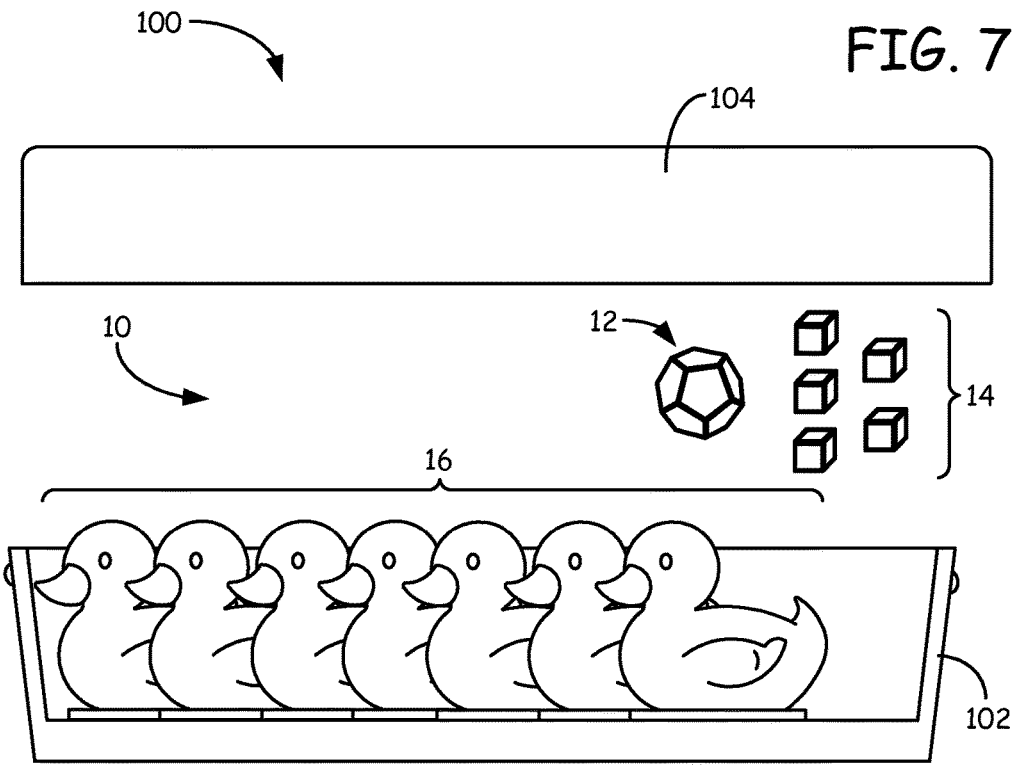
FIG. 7 is a side schematic illustration of a kit of the playing pieces for playing the entertainment method of the present disclosure.

As discussed above, the methods disclosed herein may be performed with a physical kit of playing pieces. FIG. 7 illustrates kit 100, which is an example of a suitable physical kit of playing pieces for playing the game. As shown, kit 100 includes playing pieces 10 (i.e., master die 12, scoring dice 14, and scoring tokens 16), container base 102, and container lid 104.

In this embodiment, container base 102 and container lid 104 may be opened and closed to create a container for storage and transport of playing pieces 10. Furthermore, as shown, container base 102 may also function as a token bank for retaining available scoring tokens 16 during game play. For example, container base may be illustrated to appear as a pond for scoring tokens 16 that include duck images.

As also discussed above, the methods disclosed herein may be performed with an electronic system. For example, the game may be played in a casino with a live dealer using for example, dice or a special set of playing cards, on a video gaming machine, with software on a personal or handheld computer, or with any other computer-based machine (e.g., personal data assistants (PDAs), cell phones, smart phones, tablets, and the like) capable of simulating dice or any other mechanism capable of generating a plurality of random value designations. Devices useful for these purposes include gaming devices, computer displays, television displays, cell phone displays, handheld games, or similar visual display devices. A processor, such as a microprocessor, is used to drive the visual display device to generate images of dice (or other electronic expressions thereof) and images simulating game play and scoring.

Figure 8:
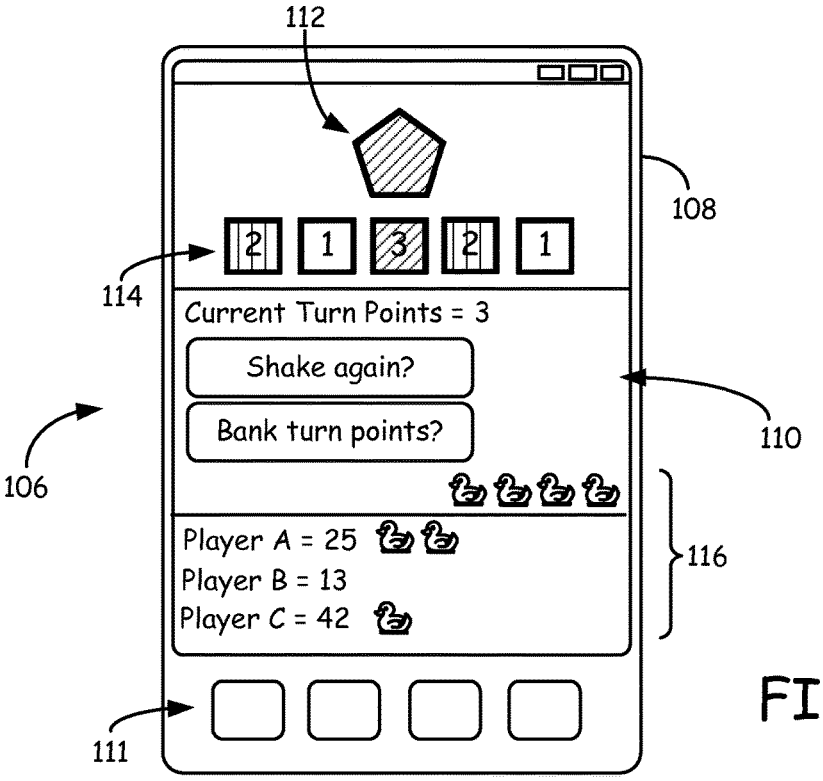
FIG. 8 is a schematic illustration of an electronic system for playing the entertainment method of the present disclosure.

For example, FIG. 8 illustrates system 106, which is a computer-based machine that includes body portion 108, graphical user interface (GUI) 110, and user controls 111. System 106 also includes a processor used to drive GUI 110 to generate images of master die indicator 112, scoring dice indicators 114, and scoring token indicators 116, as well as images of player points and collected scoring tokens 116, and selectable menus.

In some embodiments, user controls 111 may be integrated into GUI 110, such as with a touch-screen display, or may be any suitable input device such as a keypad, mouse, speech entry, stylus, and the like. System 106 may also include an audio output component (not shown). In further embodiments, credits (including monetary credits) can be transferred in and out of system 106 electronically, by credit or cash card, by tokens, by cash or other means of transferring credits.

Linking between multiple linked systems 106 can be completed by wireless or wired networks, optical communication, singly or in combination, including but not limited to the internet, local area networks, or wide area networks. Winning of players can be credited to individual players, or paid to a single pot in a fund raising event. Tournament play is also contemplated, and the payout may comprise naming a tournament champion or other title. The additional video games can also be used as a research tool for the study of player behavior.

In such "virtual" versions of the game, one embodiment involves one or more real players and/or one or more virtual players (run by the machine) competing using a designated playing system. Rather than an upwardly facing master side (see, e.g., face 18 in FIG. 1) of a physical master die 12, a selected random master designation is generated on a master indicator. A player begins a turn, by causing or "shaking" the playing system to generate one master designation from a group of master designations and at least one reference designation form a group of reference designations. A player's score for that turn is obtained according to a scoring system. The player may earn points for each score value associated with a reference designation that matches the master designation, as discussed above for methods 36 and 78 (shown in FIGS. 5 and 6).

Time delays may also be inserted into selected parts of the virtual game operation on an heuristic basis to increase enjoyment of the game. Sound effects (generated by sound files or otherwise) are included to increase enjoyment of the game. Visual effects can be used in combination with changing textual messages and numeric results to increase enjoyment. Odds of winning various pots can be displayed in combination with other visual effects. Furthermore, the virtual games can be programmable by the operator to select different payouts, visual effects, sound effects, types of credits and the like appropriate for a playing environment.

In addition, the game described above can be adapted to provide progressive features, bonus features, or both bonus and progressive features and the like. The progressive features, bonus features or both progressive and bonus features can also be adapted to other kinds of games (non-dice games) where there are repetitive plays. The progressive feature comprises an option in the game so that, after each successful roll of virtual dice (or other play in non-dice games), the player can either select to make the next roll (play) as usual, or to make the next roll (play) by risking the winnings of a previous play on the next play, or to cash out. The game can be played with points, virtual monetary amounts or other symbols.

The game with progressive features can be played on an individual machine (computer, cell phone, PDA, casino gambling machine, etc.) that is joined in a group of machines. Within the group of machines, points or virtual monetary amounts can be linked together to accumulate bonus points or bonus monetary value in bonuses (at time intervals, for example, such as hour, day, week, month, holiday season, special event, etc.) that can be won on any machine in the group of machines. Progressive play at each machine contributes to the group bonuses, and players at each machine have an opportunity to reach a bonus level (spin at 40 points or credits, for example) in a game and get an opportunity to play a bonus round to win one of the bonuses. In one embodiment, the play in the bonus round is also progressive play.

The game with progressive features can be played on an individual machines that is used at different times by different users so that bonuses can accumulate and be available for winning by later players. For example, a player loads a machine with a starting amount, say $50, and uses a portion of that starting amount, say $3, to roll dice (start play). If the play is successful and the player wins money, for example, $0.50, then the amount won can be risked on the next roll, namely $3.50, so that the amount won on the next roll, if successful, will be increased. This progressive feature can be exercised one or more times by the player as the game progresses. The progressive feature can permit a player to enjoy an effort to increase winnings during a perceived "streak" of good luck.

In one embodiment, a long term average amount ("hold") returned by the game to the players is in the range of 90-99% of the amounts risked by the players to provide a large number of wins for the players. The small difference between the amount risked and the hold is retained by the operator of the game.

A certain amount of money can be put in to a player's pot on the machine, for example $50. A play could be started with a smaller amount, for example $3. The start of play reduces the pot to $47. Play can be winning and add to the amount in the pot further. A streak of winning plays can be stopped at any time by the player, and the amount is added to the pot. If a streak ends in a loss, however, then no amount is added to the pot.

Although the entertainment apparatus and method disclosed here has been described with reference to preferred embodiments, workers skilled in the art will recognize that changes may be made in form and detail without departing from the spirit and scope of the entertainment apparatus and method.

The invention claimed is:

1. An entertainment method comprising:

providing a master die comprising multiple sides, each side having one of a master designations and a token designation;

providing a plurality of scoring dice each having multiple sides with each side having a reference designation corresponding to one of the multiple master designations of the master die, and having a score value associated with each reference designation;

shaking the master die and the plurality of scoring dice to cause one side of the multiple sides of the master die to appear as a top side of the master die and one side of each of the plurality of scoring dice to appear as a top side of the respective scoring die;

the top side of the master die exhibits a shown master designation or shown token designation;

the top sides of the plurality of scoring dice each exhibit a shown reference designation;

accumulating turn points when the shown reference designation of at least one shaken scoring die corresponds to the shown master designation;

forfeiting turn points when no shown reference designation of the shaken scoring dice corresponds to the shown master designation; and collecting a first scoring token when the shaken master die shows the token designation, wherein the scoring token has an assigned value.

2. The method of claim 1, and further comprising collecting a second scoring token when each of the shown reference designations of the shaken scoring dice is identical.

3. The method of claim 1, and further comprising:

repeating the shaking, depositing and accumulating steps to accumulate the turn points until a zero-value shake occurs, wherein no shown reference designation of the shaken scoring dice corresponds to the shown master designation;

forfeiting the accumulated turn points; and ending the turn.

4. The method of claim 1, and further comprising banking the accumulated turn points to prevent forfeiture of the banked points.

5. The method of claim 4, and further comprising comparing the banked points to a predetermined threshold score.

6. The method of claim 5, wherein, when the compared banked points are equal to or exceed the predetermined threshold score, adding the assigned value of the collected first scoring token to the banked points.

7. The method of claim 1, wherein collecting the first scoring token comprises taking the first scoring token from another player when a supply of scoring tokens is empty.

8. An entertainment method comprising:

shaking a master die comprising multiple master designations and a token designation;

shaking a plurality of scoring dice each having multiple reference designations corresponding to the multiple master designations of the master die, and that do not correspond to the token designation;

depositing the master die on a surface so that a top face of the master die exhibits a shown master designation or shown token designation;

depositing each of the plurality of scoring dice on the surface so that a top face of each scoring dice exhibits a shown reference designation;

comparing the shown master designation or shown token designation to the shown reference designations; and providing alternative options when the shaken master die shows the token designation, the alternative options comprising:

collecting a first scoring token and ending a turn; and forgoing collection of the first scoring token and repeating the shaking of the master die and the shaking of the scoring dice.

9. The method of claim 8, and further comprising:

comparing shown reference designations of the shaken scoring dice; and collecting a second scoring token when each of the shown reference designations of the shaken scoring dice is identical.

10. The method of claim 8, and further comprising accumulating turn points when a shown reference designation corresponds to the shown master designation.

11. The method of claim 10, and further comprising banking the accumulated turn points to prevent forfeiture of the banked points.

12. The method of claim 11, and further comprising:

comparing the banked points to a predetermined threshold score; and adding an assigned value of the collected first scoring token to the banked points when the compared banked points are equal to or exceed the predetermined threshold score.

13. The method of claim 8, and further comprising forfeiting turn points when no shown reference designation corresponds to the shown master designations.

14. An entertainment method comprising:

(a) shaking a master die comprising multiple master designations and a token designation;

(b) shaking a plurality of scoring dice each having multiple reference designations corresponding to the multiple master designations of the master die;

(c) depositing the master die on a surface so that a top face of the master die exhibits a shown master designation or shown token designation;

(d) depositing each of the plurality of scoring dice on the surface so that a top face of each scoring dice exhibits a shown reference designation;

(e) accumulating points based on comparisons of the shown master designation or shown token designation and the shown reference designations;

(f) collecting a scoring token when the shaken master die shows the token designation;

(g) repeating at least steps (a)-(e) until the accumulated points are equal to or exceed a predetermined threshold score; and (h) adding an assigned value of any collected scoring token to the accumulated points to determine a total point value.

15. The method of claim 14, wherein steps (a)-(h) are performed in an initial round of the method, and wherein the method further comprises:

establishing a winning score to beat from the total point value determined in step (h); and performing a final round of the method in which opposing players attempt to surpass the winning score to beat.

16. The method of claim 14, and further comprising collecting a second scoring token when each of the shown reference designations of the shaken scoring dice is identical.

17. The method of claim 16, wherein one of the reference designations is the rarest of the reference designations of each scoring die, and wherein the method further comprises declaring a winner when each of the shown reference designations is the rarest reference designation.

18. The method of claim 14, and further comprising banking the accumulated points to prevent forfeiture of the banked points.

19. The method of claim 14, and further comprising forfeiting turn points when no shown reference designation of the shaken scoring dice corresponds to the shown master designation.

20. The method of claim 19, and further comprising ending a turn.

* * * * *